United States Patent [19]

Shea

[11] 4,370,111

[45] Jan. 25, 1983

[54] ROTARY PUMP OR MOTOR WITH DRIVE ROLLERS AND FREE-FLOATING ROLLERS

[76] Inventor: Robert H. Shea, 35 Lancester St., Rochester, N.Y. 14615

[21] Appl. No.: 260,272

[22] Filed: May 6, 1981

Related U.S. Application Data

[63] Continuation-in-part of Ser. No. 89,111, Oct. 29, 1979, abandoned.

[51] Int. Cl.[3] ..... F01C 1/00; F01C 11/00; F03C 2/00; F04C 2/00

[52] U.S. Cl. ..... 418/212; 418/225

[58] Field of Search ..... 418/35, 61 R, 104, 212, 418/225, 227

[56] References Cited

U.S. PATENT DOCUMENTS

| | | | |
|---|---|---|---|
| 436,399 | 9/1890 | Carpenter | 418/225 |
| 1,762,418 | 6/1930 | Petersen | 418/225 |
| 2,068,570 | 1/1937 | Ross | 418/225 |
| 2,672,825 | 3/1954 | Quintilian | 418/225 |
| 3,641,985 | 2/1972 | La Forge | 418/227 |

FOREIGN PATENT DOCUMENTS

| | | | |
|---|---|---|---|
| 426318 | 10/1947 | Italy | 418/225 |
| 342561 | 2/1931 | United Kingdom | 418/225 |
| 442201 | 2/1936 | United Kingdom | 418/225 |

OTHER PUBLICATIONS

Article—Large-Displacement Roller Pump Improves Performance, p. 56, Nov. 3, 1980 Edition of Design News.

Letter Dated Dec. 2, 1980 was sent by Advanced Mechanical Ideas, Inc. to Companies requesting more information.

Advertisement "Positive Displacement Pump-/Motor-104677", p. Mf-4 of vol. IV, No. 3, Mar. 1980, Selected Business Ventures, by General Electric.

A Cover Letter from Advanced Mechanical Ideas, Inc. attached to a packet of Information.

Article-Eccentric Pumps Turn to Novel Motions, pp. 37-40 of Design Engineering, Jan., 1981, see col. 1, p. 37 and cols. 2, 3 on p. 40.

*Primary Examiner*—John J. Vrablik

*Attorney, Agent, or Firm*—Shlesinger, Fitzsimmons & Shlesinger

[57] ABSTRACT

A pump or motor has a plurality of spaced drive rollers which rotate in an annular path in a chamber about an axis eccentric to the axis of the chamber. A plurality of free-floating rollers in the chamber are driven through the chamber by the drive rollers to form expanding and contracting areas in the chamber which control the flow of fluid into and out of the chamber. Another free-floating roller or member is centrally located between the drive rollers, and it is concentric with the path of the drive rollers. The centrally located roller is closely adjacent to the drive rollers and forms therewith a fluid seal that prevents any substantial fluid leakage therebetween.

13 Claims, 9 Drawing Figures

ROTARY PUMP OR MOTOR WITH DRIVE ROLLERS AND FREE-FLOATING ROLLERS

CROSS REFERENCE TO RELATED APPLICATION

This application is a continuation-in-part of application Ser. No. 089,111, filed Oct. 29, 1979, entitled Pump or Motor Construction, now abandoned.

BACKGROUND OF THE INVENTION

This invention relates to a reversible pump or motor construction having displacable free-floating rollers which move with respect to drive rollers during operation.

Numerous types of rotary pumps, motors or compressors are known to the art. Some prior art devices utilize an eccentrically mounted rotor within a generally cylindrical housing and have displacable members that move with respect to the rotor and the chamber in which it rotates to either compress a fluid (in the case of a pump) or to transmit fluid pressure to a rotor (in the case of a motor). For example, U.S. Pat. No. 2,465,595 which issued to H. J. Kratzer on Mar. 29, 1949, discloses a positive displacement oscillating roller vane pump having a rotor of a unique shape that is eccentrically mounted with respect to a pump housing in which the rotor rotates. Three displacable roller members are provided, each of which is mounted on arms and controlled by movement of the arms and by the rotor. These rollers, like others in the prior art, are not "free-floating" but instead are supported by arms, spiders or other similar devices. Moreover, many prior art devices, like those shown in U.S. Pat. No. 2,465,595, are not reversible.

In some prior art devices, such as discosed in U.S. Pat. No. 2,036,711 which issued to H. F. Martin on Apr. 7, 1936, an eccentric pump rotor has sliding friction with the inner surface of a pump chamber. The sliding friction in the Martin pump is transmitted through floating rollers, which are confined in radially extending slots in the rotor. A similar rotary engine or pump is disclosed in U.S. Pat. No. 232,017, and a related rotary compressor is disclosed in U.S. Pat. No. 2,562,698. Other apparatus generally relating to the type of pump or motor of the present invention are disclosed in U.S. Pat. Nos. 331,939; 345,885 and 1,317,352.

British Pat. No. 342,561, issued Feb. 5, 1931 to Bever, relates to a rotary pump in which a rotor shaft is eccentrically positioned within a pump casing. A plurality of drive rollers in the casing are supported by discs carried by the shaft so that rotation of the shaft drives the rollers in an annular path about the axis of the shaft. Strips embedded in the drive shaft are biased against the drive rollers to prevent leakage between the shaft and rollers. Each drive roller pushes in front of it an impelling roller than engages and follows the surface of the pump casing. Thus the drive rollers travel along a path concentric with the drive shaft and the impelling rollers travel along a path concentric with the pump casing. As a result, the space between any two impelling rollers increases during part of a revolution through the casing to create a suction, and the space decreases during another part of the revolution to create a pressure.

Italian Pat. No. 426,318, issued Oct. 23, 1947 to Urso, discloses a pump or compressor having a driven cylinder eccentrically located inside a hollow pump cylinder. A first set of driven rollers contacts the driven cylinder and are rotated about their individual axes in response to rotation of the driven cylinder. A second set of driven rollers contacts the wall of the pump cylinder and the first set of rollers so that rotation of the first set of rollers is imparted to the second set of rollers. As the sets of rollers rotate through the space between the driven cylinder and the pump cylinder, the spacing between adjacent rollers increases and decreases, thereby alternately creating a suction force and a pressure force that draws fluid into the pump inlet and forces the fluid out of the pump outlet.

U.S. Pat. No. 2,672,825, issued on Mar. 23, 1954 to Quintilian for a hydraulic pump and motor, discloses a toothed rotor or shell having recesses. Rollers are located parly in the recesses and are contacted by the rotor during operation of the pump or motor.

SUMMARY OF THE INVENTION

In accordance with the present invention, a pump or motor comprises a housing having walls defining a generally cylindrical chamber. The housing has an inlet opening and an outlet opening communicating with the chamber. A plurality of drive rollers are located within the chamber, and they are mounted for rotation about their respective axis, and also for conjoint rotation about a central axis that is equally spaced from the respective axis of the rollers and eccentrically located relative to the axis of the chamber. Each of the rollers is spaced from the housing and from each other during rotation about the central axis. A plurality of free-floating rollers are arranged within the chamber so that one of the free-floating rollers is between each two adjacent drive rollers. The free-floating rollers are engageable by the drive rollers, during rotation of the drive rollers about the central axis, thereby to advance the free-floating rollers through the chamber and past the inlet opening and the outlet opening. The free-floating rollers precess about the drive rollers during rotation of the drive rollers and the free-floating rollers are in contact with the wall of the chamber as they are rotated through the chamber by the drive rollers. Another free-floating member is located between the drive rollers and forms therewith a fluid seal.

BRIEF DESCRIPTION OF THE DRAWINGS

In the following detailed description of the preferred embodiment of the invention, reference is made to the accompanying drawings, in which.

DESCRIPTION OF THE PREFERRED EMBODIMENTS

In the following description reference will be made to the apparatus of the invention and its operation as a pump. However, as explained in more detail later, the apparatus also can operate as a motor.

Figure 1:
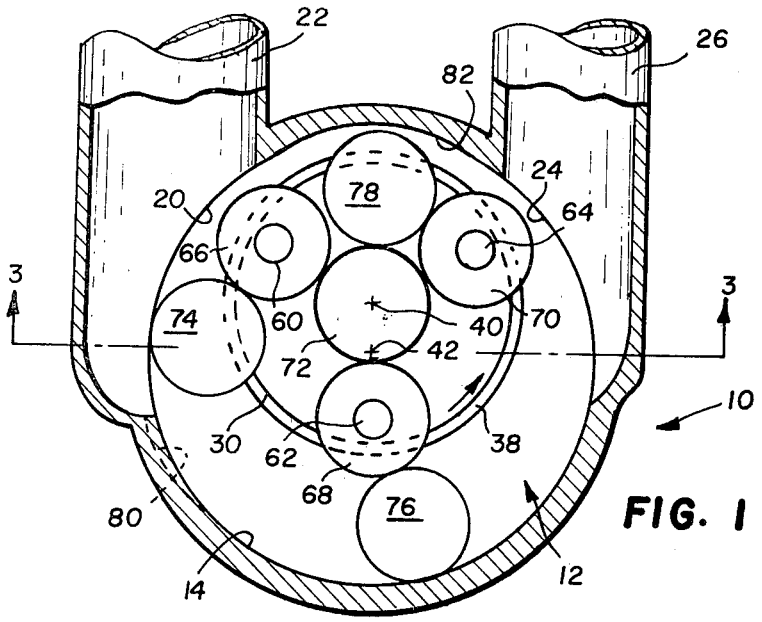
FIG. 1 is an elevation view of a preferred embodiment of a pump or motor of the present invention with parts of the pump housing cut-away.
Figure 3:
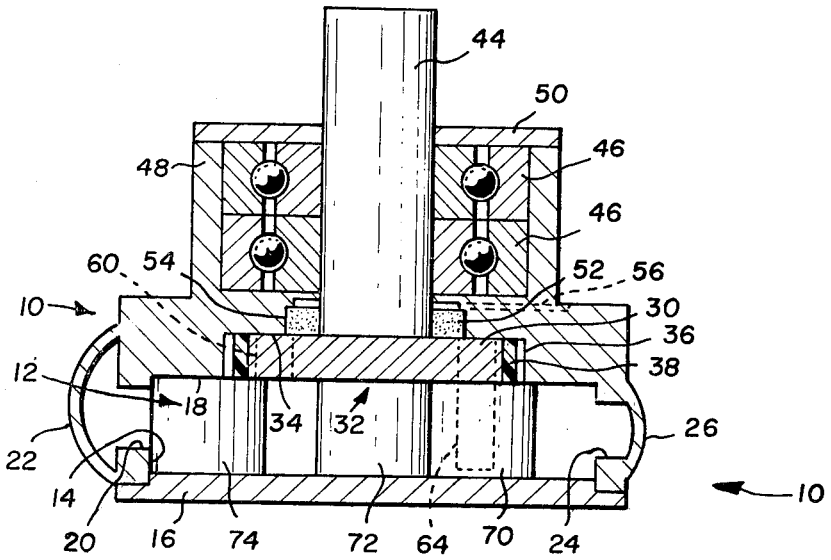
FIG. 3 is a transverse cross-section taken along line 3—3 in FIG. 1.
Figure 2:
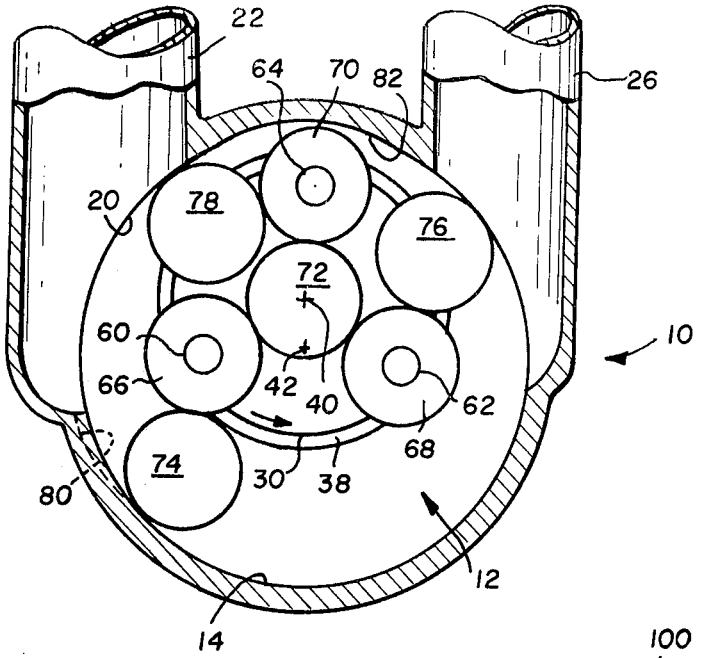
FIG. 2 is a view, similar to FIG. 1, showing some parts in a second position.

A preferred embodiment of the present invention illustrated in FIGS. 1–3 of the drawings comprises a housing generally designated 10. At one end of the housing there is a cylindrical chamber 12, formed by a cylindrical wall 14, an end plate 16 that is located in a plane perpendicular to the wall 14, and another wall 18 that is substantially perpendicular to the wall 14 and located at the opposite end of the cylindrical wall 14. An inlet opening 20 at one side of the chamber 12 communicates with a pipe or conduit 22. Fluids can be introduced to the pump chamber 12 through the conduit 22 and opening 20. Similarly, at the opposite side of the chamber 12 there is an outlet opening 24 which communicates with a pipe or conduit 26 and through which fluids can be discharged from the chamber.

A drive ring or plate 30 is positioned within a cylindrical cavity 32 in housing 10. Cavity 32 is defined by a circular wall 34, that is generally parallel to wall 18, and a cylindrical wall 36 that extends from wall 34 to wall 18 so that the cavity 32 communicates directly with the pump chamber 12. The drive ring 30 is located completely within the cylindrical cavity 32, and a sleeve 38 of nylon or other suitable anti-friction material can be provided within the cavity 32 to facilitate rotation of the ring within the cavity. As best illustrated in FIGS. 1 and 2, the cavity 32 is smaller in diameter than pump chamber 12 and the axis 40 of cavity 32 is offset from the axis 42 of the chamber 12. The importance of this relationship will be described in more detail later.

The ring 30 is connected to one end of a drive shaft 44 that extends from the end of housing 10 opposite from end plate 16. Thus shaft 44 does not project into chamber 12. The drive shaft is rotatably mounted within housing 10 for rotation about axis 40 by bearings 46 that are secured to the shaft and to a projecting portion 48 of the housing. A bearing retainer 50 is secured to the portion 48 of the housing 10 and closely surrounds the drive shaft 44. In order to prevent leakage of fluid from the pump chamber 12 along the shaft and into the bearings, a pressure seal 52 is provided around the shaft immediately adjacent to the ring 30 and within a cavity defined by cylindrical wall 54. A weep hole 56 can be provided through housing 10 from the exterior of the housing to a point immediately adjacent to the pressure seal 52 so that any fluid that finds its way past the seal will be discharged to the exterior of the housing to indicare a leaking seal.

A plurality of drive pins and drive rollers are mounted for rotation with the ring 30. As illustrated in FIGS. 1–3 of the drawings, three drive pins 60, 62 and 64 are secured to the ring 30 and support three drive rollers 66, 68 and 70, respectively. Each drive roller 66–70 is rotatable about the axis of the corresponding drive pin 60–64. Each of the drive pins and the drive rollers are equally spaced from the axis 40 of rotation of the ring 30 and drive shaft 44. The rollers extend across chamber 12 from ring 30 to wall 16.

Also located within the pump chamber 12 are a plurality of rollers that are completely free to rotate and move in response to dynamic forces applied to the rollers during operation of the pump. More specifically, four free-floating rollers 72, 74, 76 and 78 are illustrated, the number of free-floating rollers exceeding the number of drive rollers by one. Roller 72 is disposed coaxially with the axis 40 and may be referred to as the central free-floating roller. The additional free-floating rollers 74–78 are located within chamber 12 so that one roller is disposed between each two adjacent drive rollers. Thus roller 74 is located between drive rollers 66 and 68, roller 76 is located between drive rollers 68 and 70, and roller 78 is located between drive rollers 70 and 66. In the embodiment illustrated in FIGS. 1–3, the drive rollers 66–70 and free-floating rollers 72–78 preferably have substantially the same length and outside diameter.

The drive rollers are located relative to the center free-floating roller 72 so that drive rollers touch roller 72 or there is only a very small clearance between the outer surface of roller 72 and the drive rolers. By touching or having only a small clearance, a fluid seal is established that prevents any substantial leakage of fluid between the roller 72 and the adjacent surfaces of the drive rollers 66–70. When roller 72 contacts the drive rollers, it forms a rolling seal and distributes force to the drive rollers. Thus roller 72 is confined only by the three drive rollers 66, 68 and 70, by end plate 16 and by ring 30. Roller 72 is not connected to ring 30 or shaft 44 even though it is coaxial therewith. The drive rollers do not touch any part of wall 14, and the free-floating rollers 74, 76 and 78 do not touch roller 72.

During operation of the apparatus as a pump, shaft 44 is rotated in a counterclockwise direction (as viewed in FIG. 1) by a motor, for example. Rotation of shaft 44 drives the ring 30 in a counterclockwise direction about axis 40 as shown by the arrow in FIGS. 1 and 2. The ring, in turn, drives the drive rollers 66, 68 and 70 in a counterclockwise direction along an annular path about the axis 40. As noted earlier, axis 40 is offset from the axis 42 of chamber 12. As the drive rollers travel through chamber 12, the cylindrical surface of each of the rollers comes very close to (but does not touch) the wall 14 of the chamber 12 in the portion of the path shown at the top of FIG. 1 See roller 70 in FIG. 2. When each drive roller 66–70 is separated from wall 14 by its maximum distance, it is spaced from wall 14 by a distance slightly less than the diameter of one of the free-floating rollers 74–78. This relationship is shown by rollers 68, 76 in FIG. 1.

As the drive rollers travel through the chamber 12, each drive roller engages the free-floating roller 74, 76 or 78 immediately ahead of the respective drive roller in a counterclockwise direction, thereby to effect rotation of rollers 74–78 in a counterclockwise direction throughout the chamber. The rollers 74–78 not only move in a counterclockwise direction, they also are urged into a position between their respective drive roller and wall 14 as soon as a pressure differential occurs between the inlet opening 20 and outlet opening 24. Thus rollers 74–78 engage and travel along the wall 14 of chamber 12. The rollers traverse an annular path about axis 42. There is rolling contact between the free-floating rollers 74–78 and the wall 14 of the chamber, and also between each of these free-floating rollers and the drive roller that is immediately clockwise therefrom. Each free-floating roller 74, 76, 78 precesses the respective drive roller as the rollers progress around the pump cavity, i.e., each free-floating roller moves along the outer surface of a drive roller as shaft 44 and ring 30 rotate 360°. This creates a large internal volume change. The increasing volume change is at inlet opening 20 and the decreasing volume change is at outlet opening 24.

The drive rollers 66, 68 and 70 are freely rotatable about their respective axis but they are not in contact with each other nor do they contact the wall 14 of the chamber. Therefore, as the outer free-floating rollers 74–78 ride against wall 14 they tend to be rotated about their own axis in a clockwise direction. This clockwise rotation of each free-floating roller is imparted to the driving roller in contact therewith to effect counterclockwise roation of each of the drive rollers about their respective axis. Thus the outer free-floating rollers contact both the wall 14 and a drive roller without having any significant sliding or rubbing friction with either the wall 14 or the drive roller. The extent of rotation of the free-floating rollers, and thus the drive rollers, is a function of the dynamic forces present within the pump, and wear on the surfaces of the rollers and the wall 14 of the chamber is minimized. Moreover, even if some wear does occur it is compensated for by the fact that the rollers 74–78 are free-floating and simply adjust their relative positions in response to the amount of space available.

During counterclockwise rotation of the parts from the position illustrated in FIG. 1 to the position illustrated in FIG. 2, the free-floating roller 74 moves past the inlet opening 20 to create a suction or negative pressure at the opening 20 and in the adjacent portion of the conduit 22. More specifically, a comparison of FIGS. 1 and 2 indicates that the volume of the space defined by rollers 74, 66, 72 and 78 expands substantially as the rollers are rotated counterclockwise from the position illustrated in FIG. 1. This expansion of the volume defined by the rollers creates a suction or negative pressure that pulls fluid through inlet 20 and conduit 22 into the pump chamber 12. Creation of the negative pressure is facilitated by the rolling contact between rollers 74, 66, 72 and 78, and between the free-floating rollers 74, 78 and the wall 14 of the chamber 12 which creates a fluid seal between these elements. At approximately the time that the expansion of this volume stops, the next set of rollers 78, 70, 72 and 76 travel past the inlet 20 and create a second expanding chamber that brings additional fluid into the chamber.

As the free-floating roller 76 travels from the position shown in FIG. 1 to the position shown in FIG. 2, fluid is forced through the outlet opening 24 into the conduit 26 under pressure. This results from the decreasing size of the portion of the pump chamber defined by rollers 76, 68, 72 and 70. This portion of the chamber decreases in size because the free-floating roller 76 is spaced a considerable distance from the roller 72 when the parts are in the position shown in FIG. 1; however, roller 76 precesses around roller 68 and rapidly moves radially inwardly to a position closely adjacent to roller 72 as the roller 76 is driven to the FIG. 2 position. This reduction in the size of this portion of the chamber creates a pressure that forces the fluid to be expelled through the conduit 26.

It is apparent from the foregoing description that the pump is capable of a relatively large displacement. Each free-floating roller precesses or oscillates about the axis of its respective drive roller a large angular distance, but less than 90°, around the associated drive roller during one revolution of the ring and drive shaft, and this motion of the rollers 74–78 contributes to the large displacement of the pump. Also, the point on the drive pins where pressure is applied, and where wear occurs, changes angularly as the pump rotates.

The center free-floating roller 72 fits close to drive rollers 66, 68 and 70 and forms therewith a fluid seal. Roller 72 is not connected to shaft 44 or ring 30 so it does not exert any driving force on the drive rollers.

When the pump is to be operated as a pump and in only one direction (counterclockwise rotation), then a small relief area 80 can be cut in the pump housing 10 adjacent to the inlet opening 20 to achieve more optimum suction characteristics. Also, the pump housing can be enlarged slightly in the area designated 82, i.e., between the inlet opening and outlet opening. This can be accomplished by forming wall 14 cylindrical, and then machining area 82 at a radius slightly larger than $1\frac{1}{2}$ times the diameters of the rollers, with the axis being at axis 40. The included angle of the cut is about 60°. The width of the cut is less than the length of the free-floating rollers. The area 82 helps prevent leakage between the suction and discharge areas of the pump. This area 82 results in at least one of the free rollers always being at the minimum clearance in the pump chamber. When areas 80 and 82 are not provided, some slight leakage may occur in the area shown at 82, but such leakage is not important in most operations. During operation the pressure exerted on the drive rollers by the free-floating rollers due to the fluid pressure acting on the free-floating rollers is transmitted to the other drive rollers through the center free-floating roller 72.

By reversing the direction of rotation of the drive shaft 44, the pump will operate in the same manner previously described. The conduit 26 becomes the inlet or supply conduit and the conduit 22 becomes the outlet or pressure conduit. In addition, the free-floating rollers 74, 76 and 78 are driven by different drive rollers. More specifically, roller 74 will be engaged and driven by drive roller 68, roller 76 will be engaged and driven by drive roller 70 and roller 78 will be driven by drive roller 66.

The position of axis 40 relative to axis 42 determines the flow characteristics of the pump. More specifically, if axes 40 and 42 coincide, the pump is in a neutral condition. If axis 40 is moved about axis 42 by 180°, the pump would be reversed, assuming the centers of the inlet and outlet openings are axially aligned with axis 42.

The apparatus of the invention can also be used as a motor. When operated as a motor, fluid under pressure is directed into conduit 22 (or conduit 26). As the fluid enters pump chamber 12 through conduit 22 it will engage a free-floating roller, such as roller 74, and drive it through the chamber until it engages the fixed roller ahead of it, such as roller 68. Fluid then continues to urge the rollers 74, 68 in a clockwise direction. Each of the free-floating rollers are sequentially brought past the inlet opening 20 and driven in a counterclockwise direction by the fluid entering that opening. Movement of the drive roller effects rotation of the ring 30 and of the shaft 44 attached to it. This continued rotation of the shaft 44 can be utilized for any desired purpose.

A number of advantages result from the construction of the pump or motor of the invention. First of all, the apparatus is inexpensive to fabricate and operate. There is little sliding or wiping engagement between parts, and this reduces wear and minimizes maintenance problems associated with such wear. The roller action of the pump or motor can accomodate some solid material in the fluid in the chamber without interruption of its operation even though it might be slightly damaged. The pump parts can be made corrosion resistent by proper selection of materials, such as by use of plastic materials. The apparatus is easy to repair and normally should be quiet during operation. Its reversibility also makes it suitable for use in a number of different environments.

After prolonged use some wear may occur on the bearing surfaces between the drive rollers and their respective pins. Because roller 72 is free-floating, such wear does not prevent a good seal between roller 72 and the drive rollers. Thus the seal between rollers 70, 72 in their FIG. 2 position is maintained by the force exerted by rollers 74, 66 and 68 against roller 72, which then moves against roller 70.

This device has large displacement capabilities per size, low leakage, long life, simple low tolerance construction, and high pressure capabilities. These advantages are achieved, in part, by the rolling mechanical seal between all of the mechanical pressure points between chambers. The center roller completes this chain of rolling seals and also carrys the load pressure from the drive roller when the free roller is extended out beyond the centerline of the driving roller. Rolling surfaces pick up particles during operation which would cause excessive wear if a sliding seal was used on a rolling surface. The high RPM of the center roller and the other rollers creates a dynamic seal on the ends of the rollers during operation which reduces leakages because of end tolerances.

This device offers high efficiencies at low costs. Also, this device requires tolerances in side-to-side dimension only and self adjusts in the diameter dimension. It can be constructed from materials that have large thermal expansions and high friction coefficients. These materials cannot presently be used in many devices because they must be manufactured with large seal gaps which affect the efficiency and performance of such devices.

Another advantage of this device is that high fluid pressures in the chambers does not increase the mechanical pressure on any sliding surface that is used for sealing as occurs with gear and vane type pumps. Therefore, high pressures will not produce high friction which make this device more efficient with less leakage and less wear. For the same reasons as stated above, this device works well in a dry environment where lubrication is not present in fluids being pumped. It can operate well in areas where lubrication cannot be used because of product contamination, or spark free environments, corrosive environments and even environments where abrasives are used in the product being pumped.

A number of modifications can be made in the pump-motor constructions previously described. For example, roller 72 can be replaced with a roller 90 that rotates on a pin 92 fixed to the ring 30. Preferably there is a loose fit between pin 92 and roller 90. This construction permits a second drive ring 30*a* to be fixed to the end of pin 92 opposite from ring 30. Ring 30*a* also is preferably secured to the ends of pins 60, 62 and 64 opposite from ring 30. This produces a cage that permits higher operating pressures or longer rollers for higher flow rates.

Figure 4:
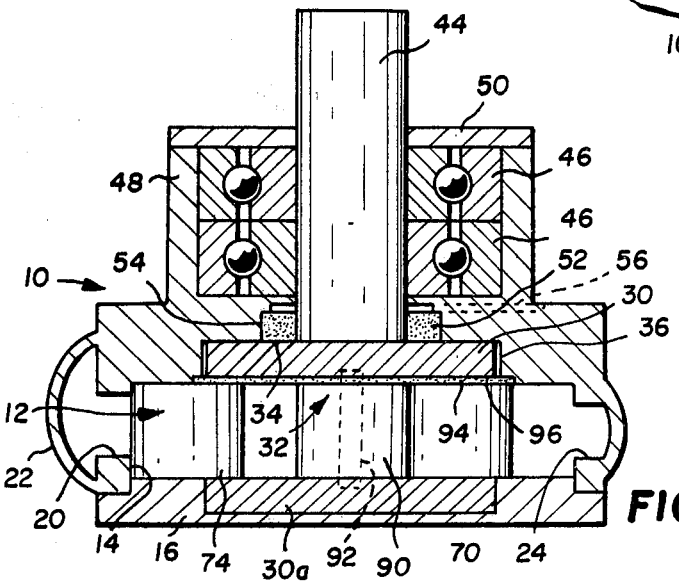
FIG. 4 is a view similar to FIG. 3 illustrating a modification of the invention having two drive rings.

Another modification shown in FIG. 4 is the replacement of seal 38 with an annular, flat seal 94 which lies beneath (inside) each ring 30, 30*a* and has a radially outer portion that engages a shoulder 96 in housing 10 adjacent the cavities for the rings 30, 30*a*. Pins 60, 62 and 64 pass through holes in seals 38, and the drive rollers keep the seals in place. Fluid pressure inside the pump chamber forces the seal tightly against shoulders 96. An increase in the fluid pressure in the pump chamber increases the pressure exerted by the seal against the shoulder, thereby increasing the effectiveness of the seal.

Roller 72 can be replaced with a member 98 (FIG. 5) which is movable relative to ring 30 and axis 40. Member 98 has a plurality of cylindrical recesses 100 in its outer surface, one recess being provided for each drive roller and free-floating roller. The recesses 100 are separated from the rollers by only a few thousands of an inch. This construction will reduce fluid carryover between cycles of operation.

Figure 5:
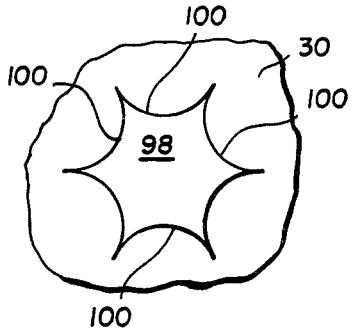
FIG. 5 is a fragmentary view of a modified central free-floating member.

This device when being used for liquids has a carryover in the top seal area of the pump which wets the end seals of the rollers and improves pumping efficiency. Although when pumping gasses, this carryover will decrease the efficiencies because gasses are compressible and a small amount of pressurized gas will be carried over into the suction side of the pump, a spider device, as shown in FIG. 5, will fill the space in between the rollers thereby decreasing the carryover. Thus this device can be used for pumping gasses where high vacuum or high pressures are required.

Figure 7:
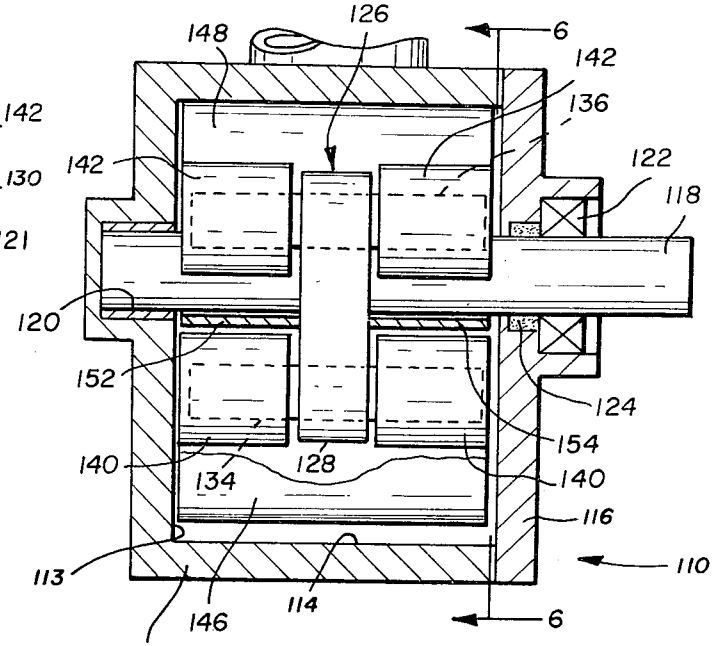
FIG. 7 is a section view through the pump or motor of FIG. 6.
Figure 6:
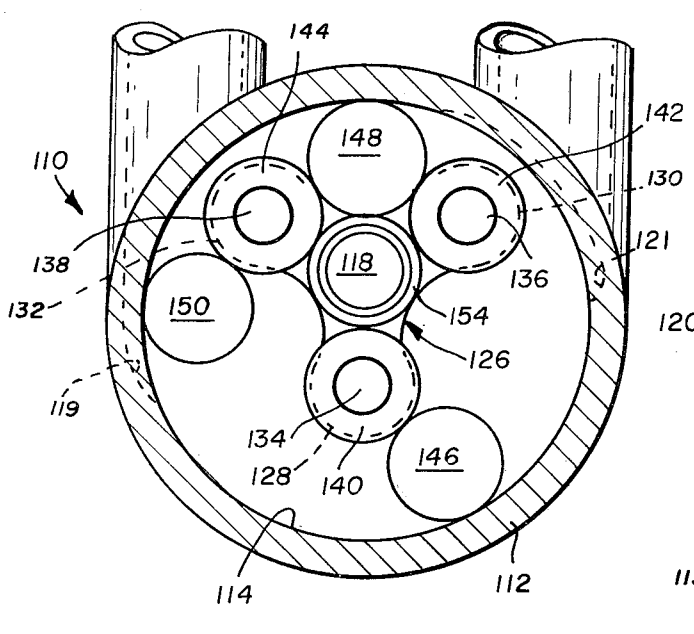
FIG. 6 is a view taken on line 6—6 of FIG. 7, and similar to FIG. 1, showing a modification incorporating a spider for supporting the drive rollers.

FIGS. 6 and 7 illustrate another modification or embodiment of a pump or motor of the present invention. The embodiment illustrated in FIGS. 6 and 7 is generally designated 110 and comprises a housing 112 having a relatively wide cylindrical chamber 114. Chamber 114 is closed at the right end of the housing by an end plate 116. The pump housing has an inlet opening 119 and an outlet opening 121 through which fluids can be introduced into and forced from the housing.

The drive shaft 118 projects entirely through the pump housing 112 and chamber 114. Shaft 118 is supported by journal bearings 120 at the inside of the housing and by bearings 122 in end plate 116. A suitable fluid seal 124 can also be provided between the end plate and the shaft 118.

A spider 126 is secured to the shaft 118 and located within chamber 114 midway between the inner surface of the end plate 116 and the inner wall 113 of the chamber opposite from the end plate. The spider has three projecting portions 128, 130 and 132 which extend outwardly from the central hub portion of the spider that is mounted on the shaft 118. The projecting portions 128, 130 and 132 are generally cylindrical in shape and have diameters that are slightly smaller than the drive rollers described later. The projecting portions each carry a pin 134, 136 and 138, respectively, which project equal distances from opposite sides of the spider and which terminate near to the inner wall of the end plate 116 and the wall 113 of the chamber.

Pin 134 carries two drive rollers, both of which are designated 140. One of the rollers fits over the left end of the pin, as viewed in FIG. 7, and extends essentially from portion 128 of the spider to wall 113 of the chamber. The other drive roller 140 fits over the right end of pin 134 and extends from adjacent portion 128 of the spider to the inner wall of the end plate 116. Similarly, pin 136 carries a pair of drive rollers 142 and pin 138 carries a pair of rollers 144. In each instance the drive rollers extend from the spider to the adjacent wall of the chamber, or close thereto, to prevent any substantial fluid leakage between the rollers and the spider and the chamber walls. The rollers are rotatable relative to the spider. This can be accomplished either by securing the pins 134 to the spider and allowing the drive rollers to rotate freely on the pins or, alternatively, the drive rollers can be rigidly secured to the pins and the pins allowed to rotate freely within the projecting portions of the spider. It is apparent from the foregoing description that rotation of shaft 118 will be imparted through the spider 126 and the three pins carried by the spider to the six drive rollers. As noted earlier, the projecting portions 128, 130 and 132 of the spider are slightly smaller than the diameter of the drive rollers so that the drive rollers project from the edges of the spider and are effective to drive the free-floating rollers as explained in more detail later.

Three free-floating rollers 146, 148 and 150 are located within pump chamber 114. Free-floating roller 146 is positioned so that during rotation in a counterclockwise direction of the spider 126, the drive rollers 140 both contact the free-floating roller 146 and move it through the pump chamber. In a similar manner drive rollers 142 engage the free-floating roller 148 and the drive rollers 144 engage free-floating roller 150. Thus there is one free-floating roller for each two drive rollers, and the free-floating rollers each extend essentially the full width of the chamber.

A pair of center free-floating rollers 152 and 154 are located inside or between the drive rollers. The free-floating rollers 152 and 154 comprise cylindrical sleeves that fit loosely around the drive shaft 118 and are located close to the drive rollers to form therewith fluid seals in the same manner as the center free-floating rollers in the embodiments described hereinbefore. Because of the space between the rollers 152, 154 and the drive shaft 118, the rollers 152 and 154 are not rotated by the drive shaft but, instead, are free to move under the influence of dynamic forces transmitted to the center rollers by the pairs of drive rollers.

In operation, shaft 118 is driven in a counterclockwise direction to rotate the spider 126 and thereby rotate the pins 134, 136 and 138 through the pump chamber 114. This movement of the pins causes corresponding movement of the three pairs of drive rollers 140, 142 and 144 through an annular path about the axis of the shaft 118. Such movement of the drive rollers is transmitted to the free-floating rollers 146, 148 and 150 which travel around the periphery of chamber 114 and along an annular path that has an axis offset from the axis of rotation of the shaft 118 and coaxial with the axis of the chamber 114. As previously described in connection with the other embodiments, the free-floating rollers not only move in an annular path but also precess about the surface of the various drive rollers. Also the free-floating rollers, the drive rollers and the center free-floating rollers form areas or volumes of changing size which create a suction at the inlet port 119 of the pump and pressure at the outlet port 121 to cause movement of fluid through the pump in much the same manner as previously described in the other embodiments.

This embodiment of the invention requires six drive rollers, instead of three, but provides a relatively large pump chamber which allows a greater volume of fluid to be pumped for each revolution of the drive shaft.

Figure 8:
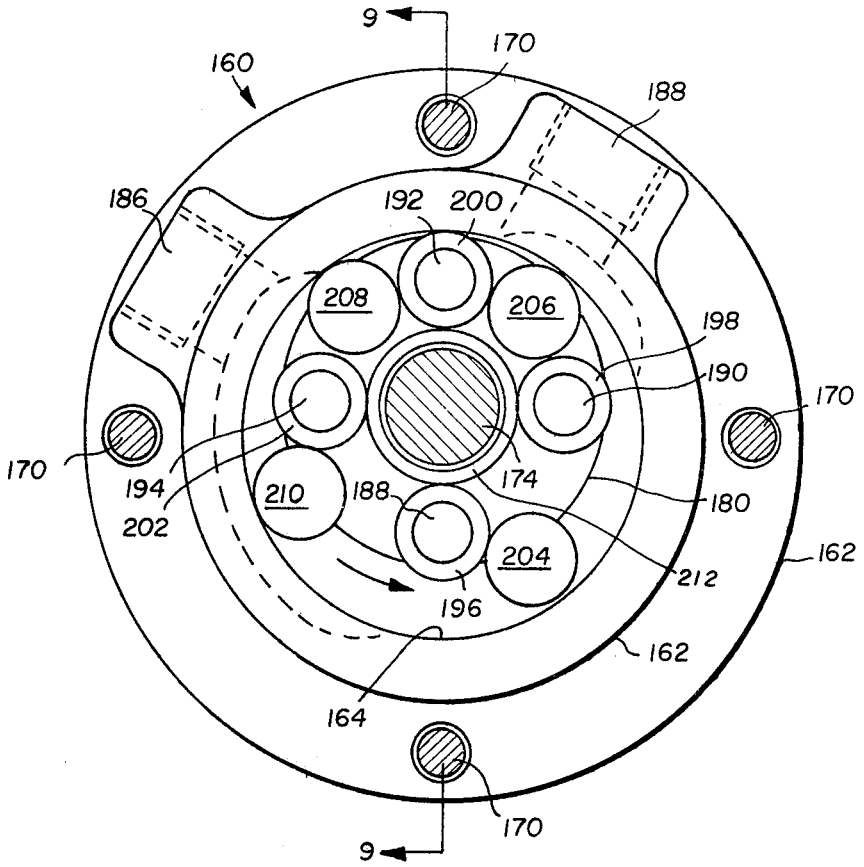
FIG. 8 is a view showing another embodiment of the invention.
Figure 9:
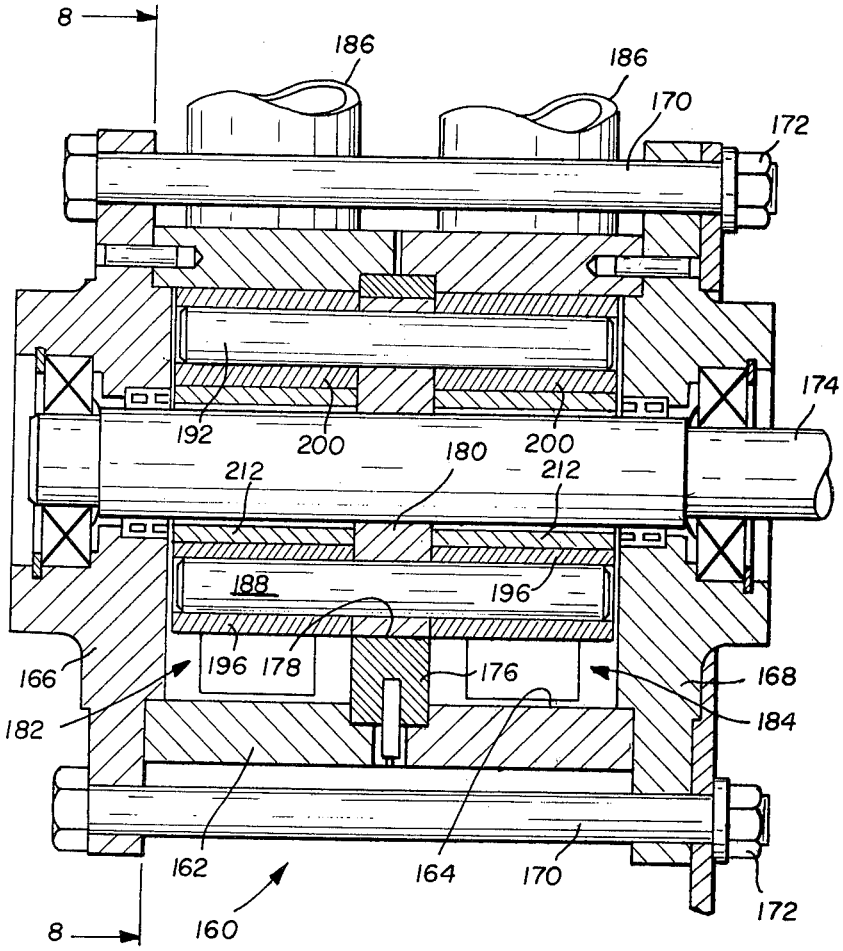
FIG. 9 is a section view taken along line 9—9 of FIG. 8.

Another embodiment of the invention is illustrated in FIGS. 8 and 9 of the drawings. In this embodiment a pump shown generally at 160 has a housing formed by a generally cylindrical housing portion 162 with a cylindrical inner wall 164 and a pair of end plates 166 and 168. The end plates and cylindrical portion are held in assembled relation by a plurality of bolts 170 and nuts 172.

A shaft 174 extends through the housing and is mounted on bearings carried by the housing. The shaft rotates about an axis that is offset from the axis of the wall 164 of the pump chamber in the same manner as in the prior embodiments.

In this embodiment, the pump housing is divided into two cavities. This is accomplished by a ring mounting member 176 which is secured to the center of the housing member 162. The mounting member 176 has a cylindrical opening 178 therein which is eccentric to the cylindrical wall 164 defining the pump chamber and which is coaxial with the axis of the pump drive shaft 174. A drive ring 180 is secured to the shaft 174 and has a cylindrical outer surface that fits closely against the surface 178 of the ring mounting member 176. Thus the ring 180, shaft 174 and the ring mounting member 176 separate the pump chamber into a pair of cavities 182 and 184. Each of the cavities of the pump has an inlet opening 186 and an outlet opening or port 188.

In this embodiment four pins 188, 190, 192 and 194 are secured to the ring 180 and project from both sides thereof into both of the pump cavities 182 and 184. Two drive rollers are mounted on each of the pins, one roller being located in each of the pump cavities. Thus, as shown in FIG. 9, pin 188 has a drive roller 196 mounted thereon and positioned in cavity 182 and another drive roller 196 mounted on the pin in the cavity 184. The drive rollers on pin 190 are designated 198, the ones on pin 192 are designated 200 and the rollers on pin 194 are designated 202.

As shown in FIG. 8, in each pump cavity four free-floating rollers 204, 206, 208 and 210 are provided and positioned so that they are driven through the pump chambers or cavities by the drive rollers 196, 198, 200 and 202, respectively. Also, free-floating rollers in the shape of cylindrical members are positioned around the shaft 174 and between the drive rollers, such center free-floating rollers being illustrated at 212. The rollers 212 are spaced from the shaft 174 so that they are not driven by the shaft but, instead, are influenced by dynamic forces transmitted thereto from the various drive rollers. The free-floating rollers 212 are closely positioned relative to the drive rollers to form fluid seals therewith as explained hereinbefore.

Operation of the pump shown in FIGS. 8 and 9 is essentially the same as described hereinbefore. Shaft 174 is driven to rotate the drive ring 180, thereby driving the four pins 188, 190, 192 and 194 through an annular path through the two pump cavities 182 and 184. This moves the drive rollers 196–202 through annular paths eccentric with the cylindrical wall 164 of the pump housing. This movement of the drive rollers drives the free-floating rollers 204–210 through the two cavities of the pump and along an annular path having its axis coaxial with the wall 164 of the pump. This movement produces a suction at the inlet port 186 of each of the pump cavities and a pressure at the outlet ports 188 of the two cavities. The result is to provide a two-cavity pump that can be rotated by a single shaft. The inlet of one pump cavity can be connected to the outlet of the other pump cavity, or the two pump cavities can be used to pump different fluids. High efficiency is achieved by utilizing two cavities operated by a single drive shaft. Additional pump cavities can be formed in the housing, if desired.

Although the invetion has been described in connection with preferred embodiments thereof it will be understood that various modifications can be made without departing from the scope of the invention as defined by the claims.

I claim:

1. A pump or motor construction comprising:

a housing having walls defining a generally cylindrical chamber with an axis, the housing having an inlet opening and an outlet opening communicating with the chamber;

a plurality of drive rollers located within the chamber;

means mounting the rollers (i) for rotation about their respective axis and (ii) for conjoint movement in an annular path about a central axis that is equally spaced from the respective axes of the rollers and eccentrically located relative to the axis of the chamber, each of the rollers being spaced from the housing and from each other during movement about the central axis;

a plurality of free-floating rollers arranged within said chamber so that one of the free-floating rollers is between each two adjacent drive rollers, the free-floating rollers being engageable by the drive rollers during movement of the drive rollers about the central axis, thereby to advance the free-floating rollers through the chamber and past the inlet opening and the outlet opening, the free-floating rollers precessing about the drive rollers during movement of the drive rollers and the free-floating rollers being in contact with the wall of the chamber as they are advanced through the chamber by the drive rollers; and a center free-floating member located between the drive rollers, the free-floating member being closely adjacent to the drive rollers to form therewith a fluid seal.

2. The invention as set forth in claim 1 wherein the mounting means comprises a ring mounted in the housing and having a plurality of pins projecting therefrom, the drive rollers being carried by the pins, and the invention further comprising a drive shaft secured to the ring and projecting from the housing, the ring and the drive rollers being rotated about the central axis in response to rotation of the shaft.

3. The invention as set forth in claim 1, wherein a portion of the inner peripheral surface of said cylindrical chamber between said inlet and said outlet has a slightly larger diameter than the remaining portion thereof.

4. The invention as set forth in claim 1, wherein during each revolution of said drive rollers about said central axis each of said free floating rollers oscillates at least once in an arc around the center of its associated drive roller, subtending an angle of less than 90°.

5. The invention as set forth in claim 1 wherein one free-floating roller is provided for each drive roller, and the drive rollers and the free-floating rollers are cylindrical in shape.

6. The invention as set forth in claim 5 wherein the free-floating member is a roller.

7. A pump comprising:

a housing having walls defining a generally cylindrical chamber, the cylidrical chamber having a first axis and the housing having an inlet opening and an outlet opening communicating with the chamber;

a drive member positioned in said housing;

a drive shaft coupled to said drive member for rotating the member about a second axis offset from the first axis and generally parallel to the first axis;

a plurality of cylindrical drive rollers located within the chamber and extending in a direction generally parallel to said axes;

means rotatably mounting each of said drive rollers on the drive member with the drive rollers being equally spaced from the second axis and with the axis of rotation of each drive roller being equally spaced from each adjacent drive roller whereby each of the drive rollers is rotatable about its own axis of rotation and rotatable by the drive member through an annular path about the second axis of rotation;

a plurality of free-floating cylindrical rollers positioned within the chamber so that one of the free-floating rollers is located between each two adjacent drive rollers, each free-floating roller being engageable by a drive roller during rotation of the drive rollers through the annular path, whereby the free-floating rollers are driven through the chamber by the drive rollers, and the free-floating rollers being driven around the chamber along a path coaxial with the first axis with each free-floating roller precessing around a drive roller during such movement;

the second axis being located (i) with respect to the first axis and (ii) relative to the inlet opening and the outlet opening so that the contact between the free-floating rollers, the walls defining the cylindrical chamber and the drive rollers produce variable displacement areas which enlarge in size adjacent to the inlet opening and diminish in size adjacent to the outlet opening, thereby to provide suction for drawing a fluid through the inlet opening and pressure for discharging a fluid through the outlet opening; and an additional, free-floating member located between the drive rollers and being sufficiently close to the drive rollers to form therewith a fluid seal.

8. The invention as set forth in claim 7, wherein said member located between the drive rollers has a plurality of semi-cylindrical recesses in its outer surface dimensioned to receive the drive rollers and the free-floating rollers.

9. The invention as set forth in claim 7 wherein the drive member comprises a first ring, and the invention further comprising a second ring, the rings being positioned on opposite sides of said chamber and the rollers, and said mounting means comprises a plurality of pins secured to said rings to form therewith a cage, the pins extending through an axial bore in the drive rollers.

10. The invention as set forth in claim 9 wherein the drive rollers are equally spaced from each other, the free-floating member comprises a roller located between the drive rollers, and a further pin mounted on the rings and extending through an axial bore in the free-floating member.

11. The invention as set forth in claim 7 wherein the drive member comprises a spider having a hub portion secured to the shaft and having a plurality of projecting portions, the spider being located between the ends of the chamber, and some of the drive rollers being mounted on each side of the spider.

12. The invention as set forth in claim 11 wherein the means mounting the drive rollers comprises a plurality of pins projecting to each side of the spider from the projecting portions thereof, and the drive rollers being arranged in pairs, one drive roller of each pair being on one side of the spider and the other drive roller of each pair being on the opposite side of the spider, each pair of drive rollers contacting one free-floating roller during rotation of the drive rollers through the chamber.

13. The invention as set forth in claim 11 wherein the additional free-floating member comprises a cylindrical member loosely positioned around the shaft at each side of the spider and movable independently of the shaft.

* * * * *